US005742979A

United States Patent [19]

Garcia-Hernando

[11] Patent Number: 5,742,979

[45] Date of Patent: Apr. 28, 1998

[54] ROLLING SUPPORT AND GUIDE SYSTEM FOR SLIDING DOORS

[75] Inventor: Maria del Rosario Garcia-Hernando, Madrid, Spain

[73] Assignee: Rocio Aznar Escolano, Palma de Mallorca, Spain

[21] Appl. No.: 651,258

[22] Filed: May 23, 1996

Related U.S. Application Data

[63] Continuation of Ser. No. 140,166, Feb. 9, 1994, abandoned.

[30] Foreign Application Priority Data

Mar. 11, 1992 [ES] Spain ..... 9200544
Mar. 9, 1993 [WO] WIPO ..... PCT/ES93/00016

[51] Int. Cl.[6] ..... E05D 15/00; E05F 5/06

[52] U.S. Cl. ..... 16/95 R; 16/100; 16/105; 16/86 R; 49/404; 49/462

[58] Field of Search ..... 16/97, 100, 105, 16/106, 99, 90, 86 R, 91, 86 A, 1 R; 49/404, 462

[56] References Cited

U.S. PATENT DOCUMENTS

| | | | |
|---|---|---|---|
| 821,630 | 5/1906 | Elliott | 16/41 |
| 1,274,165 | 7/1918 | Hormes | 16/100 |
| 1,824,621 | 9/1931 | Phillips | 16/100 |
| 2,594,058 | 4/1952 | Myhr | 16/100 |
| 2,680,875 | 6/1954 | Coffey | 16/105 |
| 2,741,794 | 4/1956 | Pearson | 16/105 |
| 2,917,771 | 12/1959 | Labrie | 16/105 |
| 3,363,363 | 1/1968 | Beasley, Jr. et al. | 16/1 |
| 3,509,665 | 5/1970 | Bartlett et al. | 16/91 |
| 3,750,337 | 8/1973 | Brydolf et al. | 16/90 |
| 3,852,916 | 12/1974 | Laby | 16/105 |
| 4,288,887 | 9/1981 | Johnson et al. | 16/105 |
| 4,443,508 | 4/1984 | Mehl | 49/462 |
| 4,937,979 | 7/1990 | Liou | 49/462 |
| 5,042,554 | 8/1991 | Schmidt | 16/105 |
| 5,227,217 | 7/1993 | Roberts et al. | 49/462 |
| 5,404,675 | 4/1995 | Schmidhauser | 16/87.4 R |

FOREIGN PATENT DOCUMENTS

| | | | |
|---|---|---|---|
| 522745 | 4/1931 | Germany | 16/105 |
| 348626 | 10/1960 | Switzerland | 16/105 |

*Primary Examiner*—Chuck Mah
*Assistant Examiner*—Donald M. Gurley
*Attorney, Agent, or Firm*—Dennison, Meserole, Pollack & Scheiner

[57] ABSTRACT

A rolling support assembly having a carrier with a housing configured for lateral reception within a corresponding cavity in a sliding door for frictional reception therein in a manner precluding longitudinal movement out of the cavity. The carrier mounts and provides for vertical adjustment of a depending wheel set offset to underlie the center of weight of the door and engage a pair of wheel rails provided on an underlying track including rail protecting overlying flanges and/or members.

18 Claims, 4 Drawing Sheets

ROLLING SUPPORT AND GUIDE SYSTEM FOR SLIDING DOORS

This is a continuation of application Ser. No. 08/140,166, for "GUIDING AND ROLLING DEVICE FOR COMPENSATING THE LOADS OF SLIDING DOORS", filed Feb. 9, 1994 now abandoned.

BACKGROUND OF THE INVENTION

Sliding door systems of the type utilizing a lower tracking rail have, as one problem, difficulty in providing for a proper balancing of the door. This is principally due to the fact that the tracking members and the supports associated therewith are normally assembled in an offset position relative to the mass of the door panel.

Contributing to the problem of an unbalanced door is the substantial weight of the normal door panel and the conventional use of only a single wheel at each end of the panel for the support thereof.

The typical sliding door or door panel, formed of any of a variety of materials including glass, metal sheeting, melamine veneer, and the like, will normally be approximately 2 $m^2$ in area with a thickness of approximately 16 to 22 mm and an approximate weight between 20 and 50 kg. Such a size and weight, when centrically mounted on the conventional single wheel tracking units, have a clear tendency to cause tilt to the side and deform the support, wheel axle, and the like. The unbalancing force, in addition to causing continuous eccentric axle wear, force the door's upper edge laterally against upper guiding profiles which in turn will eventually impede free movement of the door.

An example of such a system will be seen in utility model 281,597, P. Calvet, which utilizes a single wheel assembled on a flat plate attached to the side of the door panel by a metal bracket, with a screw utilized to regulate the vertical position of the bracket. The track has an open profile with a single rail for each door. The rather heavy weight of the door causes an eccentric and unbalanced load on the bracket and wheel axle causing unbalanced tracking on the rail which shortens the life of the wheels and tends to distort the mounting assembly. This in turn will eventually prevent an appropriate adjustment of the support assembly. Further, the sliding movement of the doors will be affected by the unprotected nature of the rails and the resultant tendency for dust and debris to build up, and tiny objects to accumulate therein.

A further known system COVALUX will be noted in Industrial Model No. 116,004 and is analogous to the previously described system of P. Calvet.

SUMMARY OF THE INVENTION

The purpose of the present invention is to efficiently, simply and inexpensively solve the above balance problems normally associated with sliding doors, and at the same time providing a support and guide system which is easy to assemble, handle and maintain.

Pursuant thereto, the invention, utilizing tandem wheel assemblies on each door, so relates each wheel set to the door as to position the wheels directly below the center of weight of the door. In addition, specific provision is made for the exclusion of debris from the lower rail system utilizing both a dust guard and wheel cover means which protect the individual wheels and function as rail cleaners as the wheels move therealong.

The invention also provides an upper guide or guide track for the upper edges of the sliding doors which are in turn provided with edge protectors for anti-scratching and anti-play engagement with the upper track. The proposed edge protectors, are also configured for use on vertical edges of the door, and for use as a handle.

In achieving the goals of the invention, a carrier is provided for adjustably supporting each wheel assembly. The carrier is preferably a molded unit which is set within a cavity defined adjacent to and opening through the lower edge of the door. The door cavity opens through one face of the door panel and comprises a pair of vertically communicating substantially cylindrical recesses with a narrow waist portion defined therebetween and with the lower recess opening through the lower edge of the door.

The carrier of the wheel assembly includes a hollow inner body or housing defined by opposed arcuate walls forming a pair of aligned generally cylindrical sections conforming to the recesses of the door cavity and being capable of a degree of peripheral resilient adjustability for frictional engagement within the door cavity. The carrier includes a front shield overlying the housing and bolted to the door face to mount the carrier. The front shield aligns with the lower edge of the door and includes a downwardly opening elongate recess therein which receives an elongate mounting stem. The wheel set, including a transverse axle, mounts on the lower end of the stem below the door and is vertically adjustable through a vertical adjustment of the stem. The stem is retained in its vertically adjusted position by a transverse bolt or screw engaged through a vertical slot on the stem and into a threaded bore in that portion of the front shield define the inner wall of the recess. Vertical adjustment of the stem, and hence the wheel assembly is achieved by a vertical positioning bolt engaged with the upper edge of the stem and threaded through an adjusting nut trapped within a chamber above the recess which receives the stem whereby vertical adjustment of the adjusting bolt is effected in response to rotation of the associated nut. As desired, and for ease of manipulation, the outer surface of the nut will be fluted or knurled. In order to stabilize the adjusting bolt, the bolt, both above and below the nut, extends through apertured stabilizing plates or panels.

As previously noted, it is particularly desirable that the wheel assembly aligns under the center line or center of weight of the door to accommodate the load without any unbalancing or twisting effect. As such, the adjustable stem mounting the wheel set will include an appropriate offset or laterally turned portion positioned below the lower edge of the door panel.

The lower track, which receives and guides the two wheel assemblies normally required for each door, includes two sets of wheel rails to accommodate two adjacent wheel assemblies, one on each of two bypass doors. Parallel to the two sets of wheel rails, and both centrally therebetween and coextensive therewith, is a support rail with a prism configured upper male edge which in turn mounts a dust guard. The dust guard, along the length of the track, is adapted to overlay the innermost wheel rail of each pair of wheel rails to provide a protected environment for the moving wheels. The dust guard is of T-shape in cross-section with the stem portion thereof terminating in a downwardly directed recess or female edge which frictionally engages over the central support rail to mount the dust guard. The horizontal top panel or member of the dust guard, while extending over the adjacent wheels and wheel rails, terminates short of the path along which the wheel assembly stems travel so as to not interfere therewith. Further, the dust guard is removable should any cleaning of the track and rails be required. The track also includes outer walls or panels which extend vertically, outward of the outermost wheeled rails of the two wheel assemblies, and have laterally inwardly directed upper flanges overlying the two outermost wheels and wheel rails. These flanges are generally coextensive with the horizontal panel of the dust guard to combine therewith in protecting the track.

The invention also contemplates edge protectors for the vertical edges of the doors which include relief sections thereon defined by hollow cores to provide enlarged areas which can act as cushioning means and as handles. Each of the edge protectors includes a resiliently flexible inner flange which allows for a mounting of the edge protector and a frictional engagement thereof about the edge of the door. Similar edge protectors are also provided about the upper edge of the door which will act to guide the upper edge within a simple U-shaped upper track with a central wall between adjacent doors. Further specifics of the invention will be appreciated from the drawings and the more detailed explanation of the invention following hereinafter.

DESCRIPTION OF PREFERRED EMBODIMENTS

Figure 1:
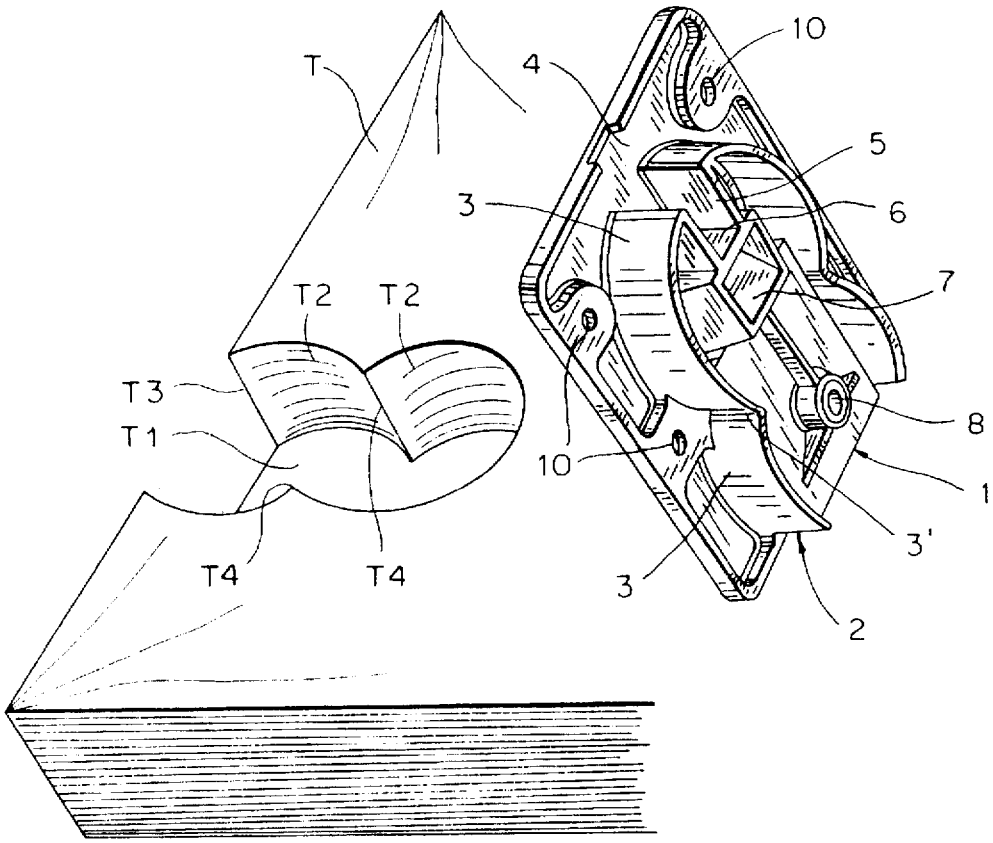
FIG. 1 is a perspective view of the wheel assembly carrier and the lower edge portion of a door panel with the cavity defined therein.
Figure 2:
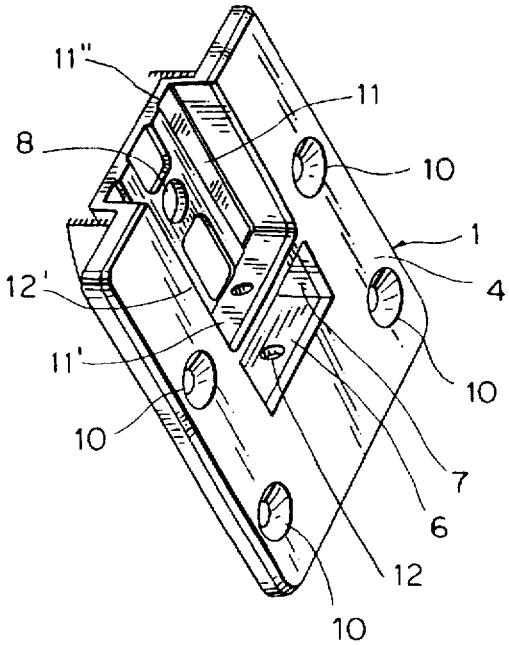
FIG. 2 is a front perspective view of the wheel carrier.

Referring now more specifically to the drawings, and in particular FIGS. 1 and 2, the sliding door or door panel T has a cavity T1 formed therein adjacent the lower edge for the reception of a wheel assembly carrier 1. The cavity T1 includes a pair of vertically aligned and communicating substantially cylindrical sections T2 with, at the area of communication between the sections T2, opposed inwardly directed ridges T4 defining a narrow waist. The lowermost cavity section, that is the one to the left in FIG. 1, while opening through the bottom edge of the door T, does so through a slightly restricted opening T3 less than the full diametric width of this lower section T2.

The carrier 1 includes a housing 2 formed by two integrally formed communicating substantially cylindrical portions 3 which are of the same configuration as the door cavity T1, including a waist portion defined by opposed inwardly directly ridges 3' at the juncture between the cylindrical portions 3. The housing 2 is of a depth slightly less than that of the cavity T1 and is specifically intended to frictionally engage therein for a stabilization of the carrier 1 in position as the wheel assembly is mounted and until such time as the carrier can be permanently affixed. This substantially contributes to facilitating installation of the support and guide system for the door.

The carrier 1 is formed as a single unit with a front or face plate 4 from which the housing 3 rearwardly extends. The front plate 4, which overlies the face of the door panel T in which the cavity T1 is defined, is secured to the door by appropriate bolts or screws extending through countersunk openings 14.

Figure 3:
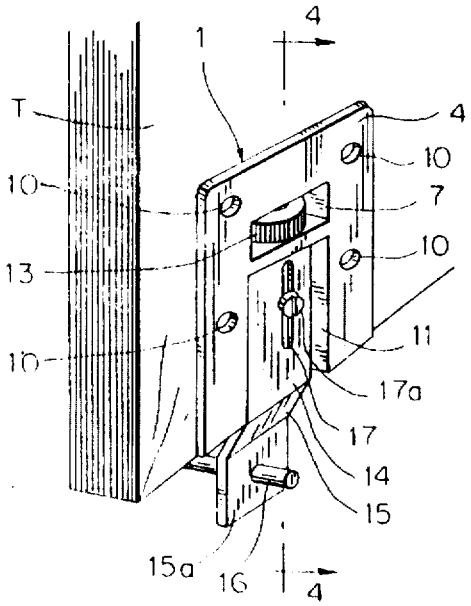
FIG. 3 is a perspective view of the wheel carrier mounted in operative position on the door or door panel.
Figure 4:
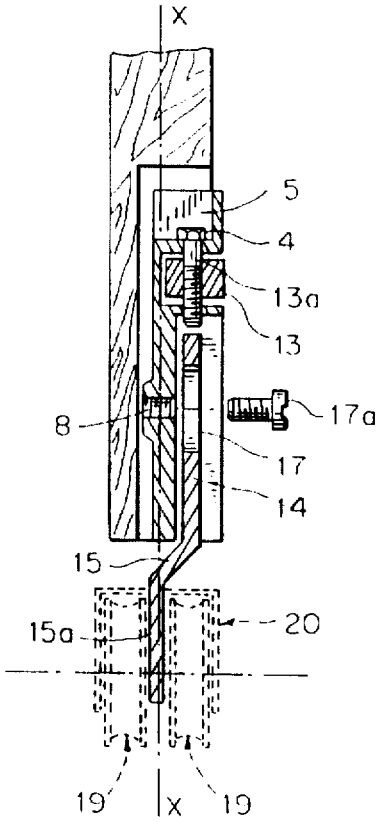
FIG. 4 is a cross-sectional view taken substantially on a plane passing along line 4—4 in FIG. 3.

Noting FIGS. 2, 3 and 4 in particular, the front plate 4, along the vertical central line thereof between the walls of the housing 3, is rearwardly offset to define a relatively wide recess 11 which is downwardly opening at the lower edge of the plate 4 as indicated at 11". The recess 11 has an upper wall 11' defining the upper end of the recess 11, and a back wall with a bolt-receiving threaded hole 8 therein.

Immediately above the recess 11, the carrier 1 includes a chamber 7 also recessed inward from the front plate 4 with the bottom of the chamber being formed by the upper wall 11' of the recess 11. The chamber 7 also includes an upper wall 6 spaced below the upper edge of the front plate 4 and defining a small upper chamber 5 on the inner side of the front panel 4.

The carrier mounts, supports and provides for vertical adjustment of the wheel assembly utilizing a vertically elongate mounting stem 14 in the nature of a rigid, narrow, flat elongate panel closely received and vertically reciprocal within the front plate recess 11. The stem 14 extends below the lower edge of the door panel T and has an offset 15 therein immediately below the door panel lower edge, the angle of the offset being such as to position the lower portion **15*a* of the panel-like stem 14 in vertical alignment with the central axis X—X of the door panel for a positioning of the wheels 14** with the load balanced thereon to avoid any tendency for the support system to distort.

Figure 5:
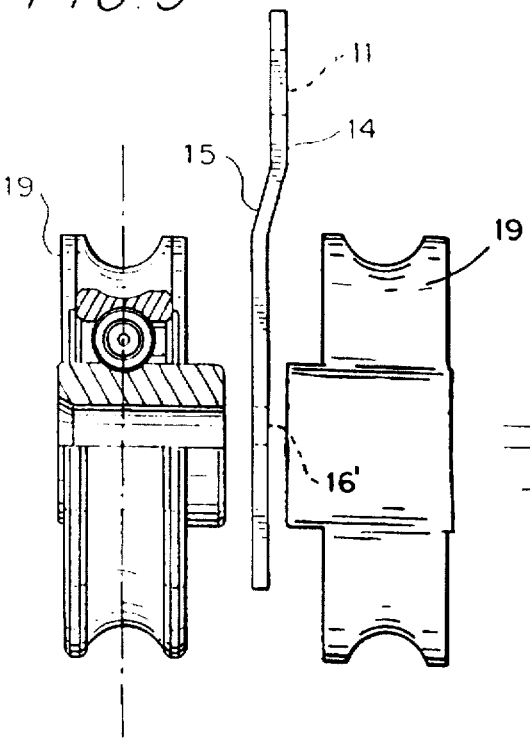
FIG. 5 is a front elevational view, partially in section and partially exploded, of a wheel set stem and two wheels.

Noting FIGS. 3, 4 and 5, the two wheels 19 of the wheel set rotatably mount to the opposed sides of the lower axially aligned stem portion **15*a* by means of a transverse axle 16 engaged through and mounted within an aperture 16' in the lower stem section 15*a***.

Once adjusted, the upper portion of the stem 14 is fixed in position by a bolt **17*a* engaged through a vertical slot 17 in the stem 14 and threaded into the bolt receiving hole 8 in the back or inner wall of the recess 11**.

In order to vertically adjust the stem 14, and hence the wheel assembly, a height adjusting bolt **13*a* is vertically extended through aligned holes 12 and 12' respectively in the parallel walls 6 and 11' of the chamber 7, the wall 11' being the upper wall of the elongate recess 11. The enlarged head of the bolt 13*a* is positioned within the upper chamber 5 to limit the adjustment of the bolt 13*a* and prevent its inadvertent withdrawal from the aligning openings 12 and 12'. The lower or abutment end of the bolt 13*a* engages the upper edge of the stem 14 with vertical adjustment of the bolt 13*a* being controlled by a nut 13 confined within the chamber 7 and through which the bolt 13*a* is threaded. Thus arranged, it will be appreciated that upon a rotation of the nut 13, the exterior surface of which is provided with an appropriate grip such as flutes or knurling, the bolt can be vertically adjusted and thus provide an upper abutment for the stem 14 for a fine adjustment thereof. The stem, when adjusted, is subsequently locked into position by the locking bolt 17*a***.

The wheels 19 of each wheel set are protected by a cowling 20 overlying the two wheels and having a central slot 21 receiving the stem vertically therethrough for free vertical sliding movement on the lower stem portion **15*a***.

Figure 6:
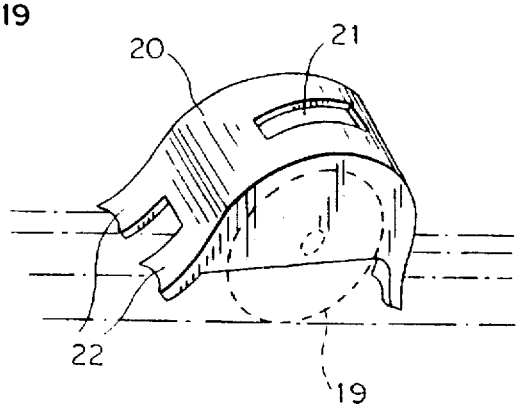
FIG. 6 is a perspective view of a combined wheel cover and rail cleaner.

Noting FIGS. 4 and 6 in particular, it will be seen that the cowling 20 is configured to arc over the pair of wheels 19 and includes opposed side panels extending below the wheel axle 16 to protectively exclude debris from the wheels.

Figure 7:
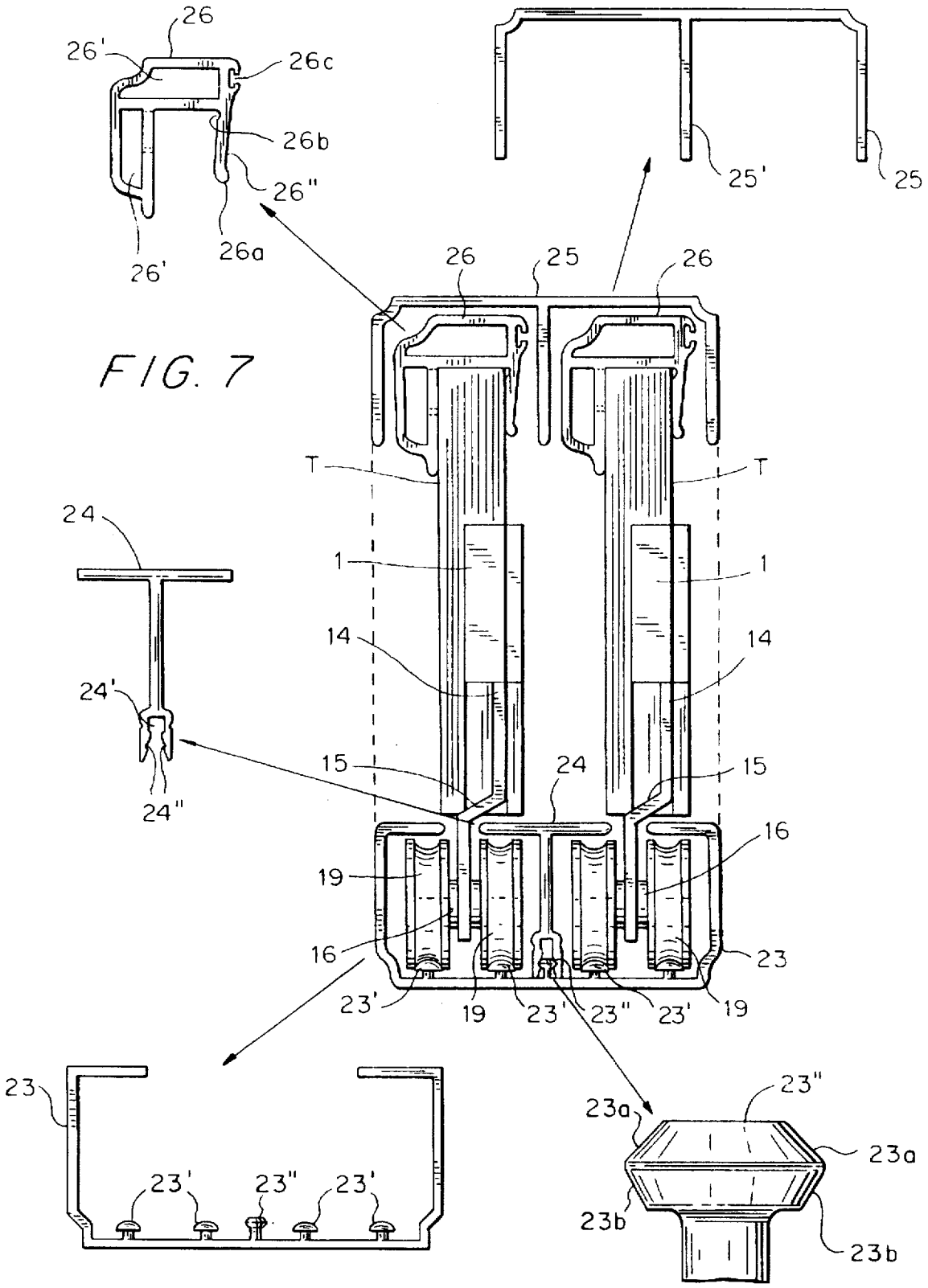
FIG. 7 is a schematic view of bypass doors with enlarged details of the associated lower and upper tracks, dust cover and edge protector.

The following and leading ends of the cowling 20, which reverse depending upon the direction of movement of the door, each include a pair laterally spaced downwardly and outwardly directed skids 22 which have the free ends thereof contoured to slide along the wheel rails 23' of the lower track 23, shown in FIG. 7, to provide for a very slight rubbing action on these rails for a cleaning of the rails immediately forward of the wheels, regardless of the direction of movement of the door.

FIG. 7 schematically illustrates the various components, both assembled and as exploded details, which provide the support and guide system for the sliding doors or door panels T. The basic support structure includes a lower track 23 incorporating the support and guiding wheel rails 23', an upper guiding track 25, a rail protecting dust guard 24, and edge protectors 26 for the top and vertical edges of the door panels.

The track 23 is to accommodate two bypass doors, and as such, includes two parallel sets of wheel rails 23'. central support rail 23" is provided between the two pairs of wheel rails 23' and extends parallel thereto. This support rail 23' has a multi-faceted enlarged upper edge portion including facets **23*a* and 23*b* defining a male component the length of the support rail 23" to which the dust guard 24** mounts.

The dust guard 24 is, in cross-section, of a T-shaped configuration with the vertical stem portion thereof terminating in a downwardly directed U-shaped connector edge 24' defining a female structure for receiving and locking to the central support rail 23". The U-shaped edge structure 24' includes internal notches 24" therein which conform to the multi-faceted enlarged upper edge of the support rail 23" which is frictionally received and locked therein.

The horizontal or transverse top member of the dust guard 24, for the length thereof, projects laterally to each side of the central vertical stem of the dust guard 24 and overlies the innermost wheel rail 23' of each of the adjacent pairs of wheel rails. The transverse panel of the dust guard 24 is at a height such as to allow for the wheels to freely move therebeneath, the cowlings 20 also of course being accommodated. As will be noted in FIG. 7, the opposed lateral edges of the transverse panel of the dust guard 24 terminate inward of the stems 14 of the wheel sets to allow for free movement thereof.

The outer wheel tracks 23', as well as the outer wheels 19 of each wheel set moving thereon, are similarly protected by a pair of overlying flanges which extend horizontally inward from the opposed vertical panels of the lower track 23 at a height substantially equal to that of the horizontal panel of the dust guard 24. These flanges, overlying the outer wheels 19, as well as the corresponding cowlings, terminate immediately outward of the wheel set stems 14 to allow for free passage thereof.

As thus assembled, the lower track, along the length thereof, is substantially enclosed other than for elongate slots defined between the inner edges of the side track flanges and the outer edges of the central dust guard 24. Access to the wheel assemblies is easily obtained by merely removing the dust cover 24. The assembly further provides for a "clean" environment by the provision of the cowlings 20 on the wheel sets which constantly engage and clean the wheel rails as the wheels move therealong.

The upper guide track 25 includes an upper horizontal panel, opposed depending edge panels and a central depending panel or wall 25' forming adjacent parallel tracks sections for receiving the upper portions of the door panels T.

Figure 8:
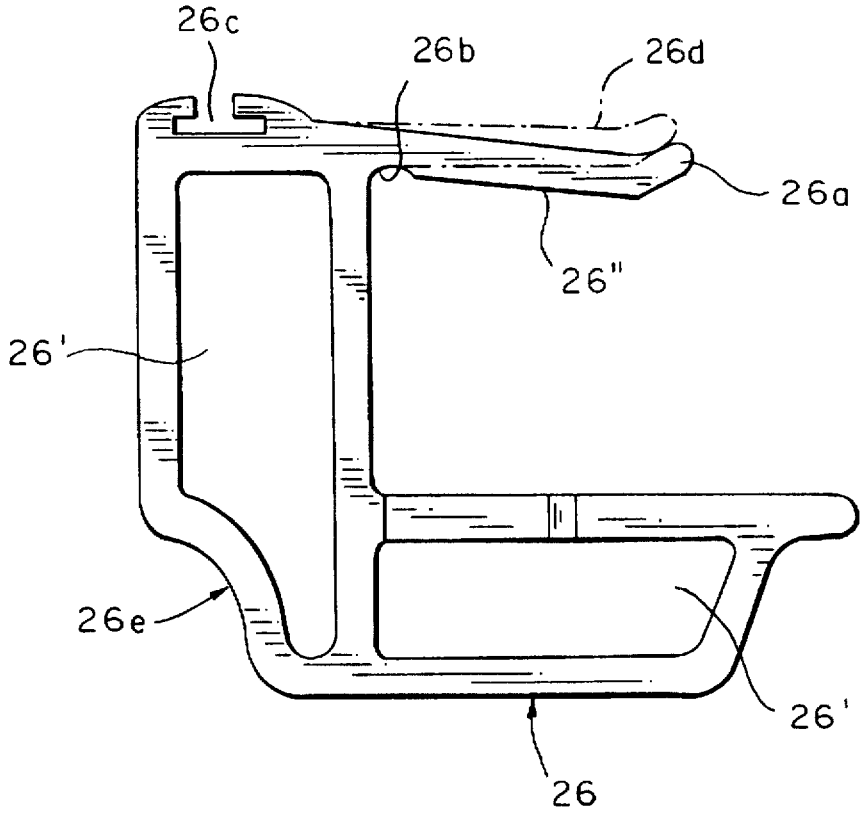
FIG. 8 is an enlarged end view of a vertical edge protector.
Figure 9:
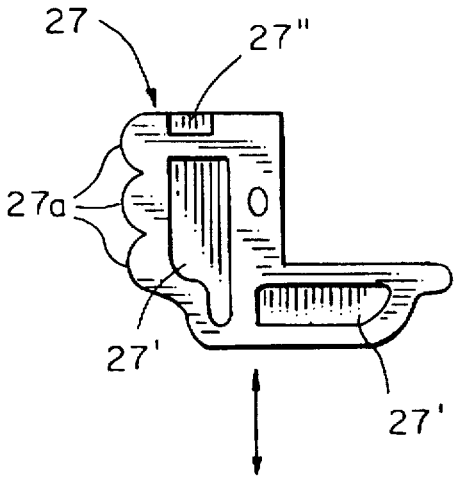
FIG. 9 is a plan view of an end cap or bracket for the edge protectors.

The edge protectors 26, noting FIGS. 7 and 8, mount on both the upper and side edges of the door T and combine to protect the edges, provide a handle means for the vertical edges, and act as a cushioning stop for the door panels at the extreme ends of their travels.

Each edge protector 26 is of a U-shaped profile or cross-section which is constant along the length thereof. The bight and one leg of the U-shaped protector 26 form hollow elongate chambers 26' having inner and outer spaced walls with the inner wall of the "leg" chamber 26', for a portion of the width thereof, being open along its length immediately adjacent the inner wall of the bight chamber 26'. The second leg 26" of the U-shaped protector 26 is formed by an elongate wall which slightly converges inward toward the first leg and is resiliently flexible relative thereto to allow for a positive frictional engagement with the edge portion of a door in order to mount the protector 26. The inner end of the leg-forming wall 26" includes a slight notch **26*b* therealong to facilitate the flexing of this leg for a positive engagement with the door panel. Similarly, the outer edge of this leg 26" is slightly outwardly bent as at 26*a* to facilitate a mounting of the protector on the door panel by an inward forcing of the protector with the leg 26"** flexing slightly laterally outward as the protector is positioned.

It will be appreciated that the edge protectors 26 are formed of an appropriate substantially rigid material which incorporates an inherent resilient flexibility sufficient as to provide for the various previously referred to functions of positive frictional mountings, protective resiliency, and the like. The notch **26*b* allows for a degree of flexibility in the leg wall 26" sufficient to accommodate variations in the door panel along the edge portions thereof to which the protector is to mount. Similarly, the opening provided in the inner wall of the chamber 26' of the other leg of the U-shaped profile 26** also provides for an increase in the resilient flexibility thereof and an accommodation of irregularities in the door edge portion.

Immediately above the leg wall 26" is a formed laterally opening channel **26*c*** which is adapted to receive a strip brush or a strip of an appropriate cushioning material as in assist and guiding the upper end of the door panel along its path of movement.

The edge protector 26, when used on the vertical edges of a door T, is also specifically intended for use as a door handle. Toward this end, and noting FIG. 8 in particular, the outermost corner of the bight forming chamber 26', above the leg chamber 26', is inwardly recessed as at **26*e*. The depression or recess 26*e*** formed in this manner allows one to conveniently engage the edge protector, and hence the edge of the door panel, and provide for a pushing of the door in the desired direction of the movement.

The opposed open ends of each of the edge protectors 26 are preferably closed by plugs 27 of an L-shaped configuration and including mounting protrusions 27' and 27" which slidably and frictionally engage within the ends of the chambers 26'. The end plugs 27, particularly those associated with the edge protectors 26 mounted on the vertical edges of the door panel T, have a projecting cushioned surface **27*a* which is adapted to extend beyond the outer wall of the bight chamber 26'** to engage against the door frame and act as a travel end stop and damper for the door panel.

Having described the nature and features of the invention with reference to the drawings, it should be appreciated that the invention is not limited to the exact details illustrated.

Rather, all suitable modifications as fall within the scope of the claims following hereinafter, are to be considered as encompassed by the invention.

I claim:

1. A rolling support assembly for a sliding door wherein said door is of a predetermined thickness between opposed first and second faces and has peripheral edges including a lower edge, an upper edge, a leading edge and a following edge; a cavity defined in said door adjacent said lower edge and inward through said first face thereof to a depth less than the thickness of said door, said cavity terminating in an inner wall and having a restricted open lower end at said lower edge of said door, said cavity, at approximately mid-height upward from said lower end having a laterally restricted central portion defining upper and lower cavity sections laterally enlarged relative to said restricted central portion and said restricted lower open end, a carrier including a housing of a configuration conforming to that of said cavity and including upper and lower housing portions conforming to and receivable within said cavity sections, said housing further including a restricted intermediate area receivable within said restricted central portion of said cavity, said housing being receivable within said cavity solely through said first face of said door, said housing being precluded from longitudinal movement in said cavity and frictionally retained therein in a manner resisting free withdrawal laterally through said first face of said door for temporary retention of said carrier as an assist to positioning and fixedly mounting said carrier, said carrier further including a face plate rigid with said housing and receivable over said first face of said door upon engagement of said housing within said cavity, fastener means engageable through said face plate and into said door for a fixed mounting of said carrier, and a wheel set mounted on and vertically adjustable relative to said carrier and below said lower edge of said door.

2. The support assembly of claim 1 wherein said carrier includes a vertical recess defined inwardly through said face plate and into said housing, said recess having an open lower end in substantial alignment with the restricted lower open end of said cavity upon a mounting of said carrier within said cavity, said wheel set including a vertical adjustment stem having an upper length vertically slidably adjustable in said carrier recess, a lower length below said carrier and parallel to said upper length, and an intermediate laterally offset extent between said upper and lower stem lengths wherein said lower length is adapted to extend below the lower edge of the door in central and balancing alignment therewith, and said wheel set including support wheels mounted on said lower length of said stem.

3. The support assembly of claim 2 including vertically adjustable screw means mounted in said carrier vertically above said stem and in abutment therewith for vertical adjustment of said stem in response to vertical adjustment of said adjustable screw means, and fixing screw means transversely engagable through said upper length of said stem and into said carrier for fixing said stem in an adjusted position.

4. The support assembly of claim 3 including a lower track for accommodating wheel sets of adjacent duplicate wheel sets, each associated with a door of a pair of doors, said lower track including two pairs of laterally spaced, parallel wheel rails, a central support rail parallel to and between said two pairs of wheel rails, each pair of wheel rails including an inner wheel rail adjacent said support rail and an outer wheel rail, said support wheels on each wheel set comprising two wheels, one accommodated on each of said inner and outer wheel rails of said pair of wheel rails, and a dust guard mounted on said support rail and laterally overlying said inner rails in vertically spaced relation thereabove sufficient to accommodate the wheels of the wheel sets therebelow.

5. The support assembly of claim 4 wherein said dust guard includes a first upright member with a bifurcated lower edge releasably clamped to said support rail, said first dust guard member including an upper portion with a second transverse member rigid therewith and projecting laterally to each side thereof, said transverse member terminating in outer edges generally aligned over said inner wheel rails, one to each side of said support rail.

6. The support assembly of claim 5 wherein said lower track includes opposed vertical panels laterally outward of said outer wheel rails and extending vertically to approximately even height with said dust guard transverse member, and track protecting edge flanges rigid with said track vertical panels and extending laterally inward therefrom generally coplanar with said dust guard transverse member and in overlying relation to said outer wheel rails, said track flanges and dust guard transverse member terminating in laterally spaced relation to each other for accommodation of the wheel set stem of each wheel set vertically therebetween.

7. The support assembly of claim 6 wherein each wheel set includes a protective cowling mounted for vertical adjustment on the lower length of the wheel set stem, said cowling overlying the two wheels of said set of wheels and extending both forwardly and rearwardly therebeyond along the direction of travel of the wheel set on the associated wheel rails, said cowling, forward and rearward of said set of wheels, including extending portions slidably engagable with the associated wheel rails for cleaning thereof as said wheel set moves along said wheel rails, the sliding engagement with said wheel rails defining vertical support for said cowling with the wheels rolling freely therebeneath.

8. The support assembly of claim 7 including edge protectors mounted to said upper edge, leading edge and following edge of said door, each edge protector being of generally U-shaped cross-sectional profile with a bight portion defined by a hollow chamber along the length of the protector, and with one leg being defined by a hollow chamber along the length of the protector and a second leg defined by a resiliently flexible panel for clamping engagement of the edge of the door between said legs.

9. The support assembly of claim 8 wherein each edge protector, along the length thereof and at a corner portion between the bight and said one leg, being inwardly recessed and defining a full length manually engageable handle means.

10. The support assembly of claim 1 including a lower track for accommodating wheel sets of adjacent duplicate wheel sets, each associated with a door of a pair of doors, said lower track including two pairs of laterally spaced, parallel wheel rails, a central support rail parallel to and between said two pairs of wheel rails, each pair of wheel rails including an inner wheel rail adjacent said support rail and an outer wheel rail, and a dust guard mounted on said support rail and laterally overlying said inner rails in vertically spaced relation thereabove sufficient to accommodate the wheel sets therebelow.

11. The support assembly of claim 10 wherein each wheel set includes a protective cowling, said cowling overlying said set of wheels and extending both forwardly and rearwardly therebeyond along the direction of travel of the wheel set on the associated wheel rails, said cowling, forward and rearward of said set of wheels, including extending portions slidably engagable with the associated wheel rails for cleaning thereof as said wheel set moves along said wheel rails, the sliding engagement with said wheel rails defining vertical support for said cowling with the wheel set rolling freely therebeneath.

12. The support assembly of claim 1 including a lower track for accommodating said wheel set, said track including a pair of laterally spaced parallel wheel rails, said wheel set including a vertical adjustment stem depending from said carrier, said stem mounting a pair of laterally positioned wheels, one to each side thereof, a protective cowling mounted for vertical movement on said stem, said cowling overlying said wheels and extending both forwardly and rearwardly therebeyond along the direction of travel of the wheel set on the wheel rails, said cowling, forward and rearward of said set of wheels, including extending portions slidably engageable with the associated wheel rails for cleaning thereof as said wheel set moves along said wheel rails, the sliding engagement with said wheel rails defining vertical support for said cowling with the wheels rolling freely therebeneath.

13. A rolling support assembly for a sliding door, said support assembly including a carrier, a wheel set adjustably mounted to said carrier, and a track receiving and guiding said wheel set, said carrier being adapted for mounting to a lower edge portion of a door, said carrier including a housing with a face plate, said face plate having a lower edge, a recess defined in said face plate and opening through said lower edge, said wheel set including an adjusting stem longitudinally received and longitudinally adjustable within said recess, said stem projecting longitudinally beyond said recess and, below said face plate, being laterally offset and terminating in a lower linear extent paralleling said face plate, adjustment means for varying the vertical position of said stem and fixing said stem in selected vertically adjusted positions, said lower extent of said stem mounting a transverse axle with a pair of wheels mounted thereon, one to each side of said stem, said track including a pair of laterally spaced parallel wheel rails for receiving and guiding said wheels therealong, a second pair of wheel rails laterally spaced from and parallel to said first pair of wheel rails, an elongate support rail parallel to and centrally between said pairs of wheel rails, and a dust guard removably mounted to said support rail and extending vertically and laterally therefrom over an adjacent wheel rail of each pair of wheel rails at a height sufficient to accommodate a wheel therebelow.

14. The support assembly of claim 13 wherein said dust guard includes a first upright member with a bifurcated lower edge releasably clamped to said support rail, said first dust guard upright member including an upper portion with a second transverse member rigid therewith and projecting laterally to each side thereof, said transverse member terminating in outer edges generally aligned over said adjacent wheel rails.

15. The support assembly of claim 14 wherein said track includes opposed vertical panels laterally outward of the outermost wheel rails of the two pairs of wheel rails and extending upward to approximately even height with said dust guard transverse member, and track protecting edge flanges rigid with said track panels and extending laterally inward therefrom generally coplanar with said dust guard transverse member and in overlying relation to said outermost wheel rails, said track flanges and dust guard transverse member terminating in laterally spaced relation to each other for accommodation of a wheel assembly stem vertically therebetween.

16. The support assembly of claim 15 wherein said wheel set includes a protective cowling mounted for vertical adjustment on said lower extent of said wheel assembly stem, said cowling overlying said wheel set and extending both forwardly and rearwardly therebeyond along the direction of travel of the wheels on the associated wheel rails, said cowling, forward and rearward of said wheels, including extending portions slidably engagable with the associated wheel rails for cleaning thereof as said wheels moves along said wheel rails, the sliding engagement with said wheel rails defining vertical support for said cowling with the wheels rolling freely therebeneath.

17. A support and guiding assembly for a sliding door, said assembly including a lower track including a base panel, two pairs of wheel rails parallel to each other and extending upward from said base panel longitudinally therealong, a central support rail on said base panel centrally between said pairs of wheel rails and extending parallel thereto, a dust guard extending along the length of said support rail and releasably fixed thereto, said dust guard extending vertically above said wheel rails and in laterally overlying relation to an adjacent wheel rail of each pair of wheel rails in vertically spaced relation thereabove and defining a protective cover for these adjacent wheel rails.

18. The structure of claim 17 wherein said lower track includes opposed vertical panels laterally outward of the outermost wheel rails of the two pairs of wheel rails and extending vertically to approximately even height with said dust guard, said vertical panels having track protecting edge flanges extending laterally inward therefrom and in overlying relation to said outermost wheel rails, said track flanges and dust guard terminating in laterally spaced relation to each other.

* * * * *